US007171968B1

(12) United States Patent
Olson

(10) Patent No.: US 7,171,968 B1
(45) Date of Patent: Feb. 6, 2007

(54) CIGARETTE DISPOSAL ASSEMBLY

(76) Inventor: John J. Olson, 1620 Oak St., Brainerd, MN (US) 56401

( * ) Notice: Subject to any disclaimer, the term of this patent is extended or adjusted under 35 U.S.C. 154(b) by 514 days.

(21) Appl. No.: 10/411,734

(22) Filed: Apr. 11, 2003

Related U.S. Application Data

(60) Provisional application No. 60/372,767, filed on Apr. 15, 2002.

(51) Int. Cl.
*A24F 13/18* (2006.01)

(52) U.S. Cl. ..... 131/235.1; 131/256; 220/908.3

(58) Field of Classification Search ..... 131/256, 131/235.1, 236; D27/102, 136, 122; 220/576, 220/315, 495.01, 908.2, 908.3
See application file for complete search history.

(56) References Cited

U.S. PATENT DOCUMENTS 1,828,068 A * 10/1931 Pringle ..... 131/256
2,437,226 A * 3/1948 Fischer ..... 220/576
3,522,812 A * 8/1970 Wilborn et al. ..... 131/242
4,142,537 A 3/1979 Fenelon
D306,259 S 2/1990 Daucourt
D389,600 S 1/1998 Luedecke
D397,496 S 8/1998 Luedecke
6,186,355 B1 2/2001 Luedecke

OTHER PUBLICATIONS

Eagle Manufacturing Company, "Safety Cans & Oilers", website, pp. 1-3.

* cited by examiner

*Primary Examiner*—Dionne W. Mayes
(74) *Attorney, Agent, or Firm*—Anthony G. Eggink; Katrina M. Eggink

(57) ABSTRACT

A receptacle for receiving and disposing of combustible articles. The assembly has a base member and a cooperating removable top member having a seal structure. A flared inlet extends from the top member and into the base member. Extinguished combustible articles, such as cigarettes, drop into a metal cavity disposed near the bottom of the base member. Securement devices are provided to safeguard the cigarette disposal assembly whereby the top member may be secured to the base member and the entire disposal assembly to a fixed object.

19 Claims, 2 Drawing Sheets

CIGARETTE DISPOSAL ASSEMBLY

This application claims the benefit of U.S. Provisional Patent Application No. 60/372,767, filed on Apr. 15, 2002.

BACKGROUND OF THE INVENTION

This invention relates generally to a receptacle for receiving and disposing of combustible articles. Particularly, this invention relates to a cigarette disposal assembly for the disposal of combustible articles such as cigarettes and the like. The disposal assembly of the invention provides an efficient means to dispose of cigarette butts, matches and the like, especially in outdoor smoking areas.

With more and more restrictions placed on public smoking, the most popular and frequently used areas to engage in smoking are now outdoors. The cigarette disposal assembly of this invention makes the maintenance of these smoking areas easy to maintain while improving the appearance of the outdoor areas designated for smoking. The cigarette disposal assembly is an economical and user friendly device that provides easy use and maintenance.

The cigarette disposal assembly may be placed in outdoor smoking areas to give employees and other smokers a sanitary disposal unit, for example. The cigarette disposal assembly may also be placed at entrances of business establishments to keep sidewalk and entrance landscapes orderly and clean.

SUMMARY OF THE INVENTION

The cigarette disposal assembly of the invention comprises a base structure and a cooperating removable top member. A centrally disposed inlet chute structure having a flared inlet and a downwardly extending conduit is positioned in the removable top member and extends into the base structure. A seal structure may be incorporated into the bottom of the top member. The seal structure is adapted to secure the inlet chute structure to the top member and to seal the removable top member to the base structure.

The inlet chute is constructed and arranged to accept combustible articles, such as cigarettes, without allowing other trash to accumulate inside the disposal assembly. Due to the constriction of the conduit portion, oxygen is limited and cigarette butts and the like are thereby extinguished and concealed to keep the surrounding property clean. The base structure preferably has a large capacity so that a large quantity of extinguished articles, i.e., thousands of cigarette butts, may be stored to thereby reduce maintenance requirements. When full, the top member may be removed and the base structure may be emptied in a manner similar to emptying a wastebasket. A steel or aluminum liner or the like may be attached or placed within the base structure, thereby eliminating the dirty job of separating the liner or container from the inside of the base structure or housing. An added weight, i.e., a quantity of sand, is provided in the base structure to make the cigarette disposal assembly stable in high traffic or windy areas.

The components of the cigarette disposal assembly, i.e., base structure, top member and seal structure, are preferably roto-molded using a polymeric resin, resistant to cracking, peeling and which provides an assembly that does not rust. A security locking system comprising a cable and lock may be provided to secure the removable top member to the base structure and to secure the cigarette disposal assembly to a fixed object to protect against vandalism and/or theft.

The disposal assembly is constructed and arranged so that emptying the disposal assembly is a clean and simple operation. The top member may be unlocked and twisted from the base structure. The entire base structure may be dumped like a waste basket. In summary, the cigarette disposal assembly is an attractive, economical and low maintenance alternative to open top ashtrays.

These and other benefits of this invention will become clear from the following description by reference to the drawings.

DESCRIPTION OF THE PREFERRED EMBODIMENTS

Figure 1:
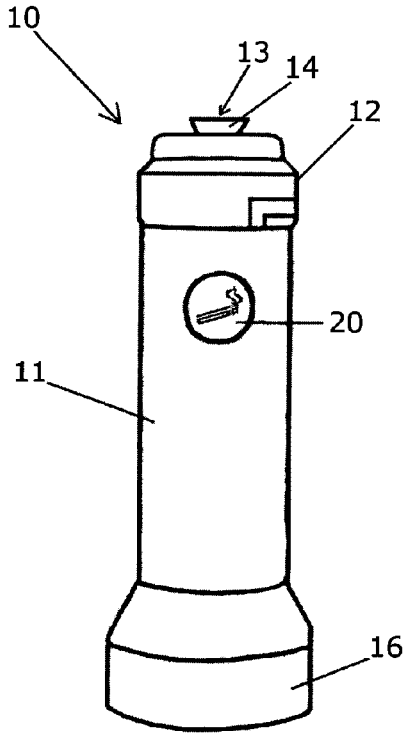
FIG. 1 is a lateral perspective view of the cigarette disposal assembly of the present invention.
Figure 7:
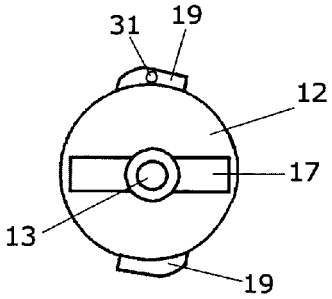
FIG. 7 is a top plan view of the assembly of FIG. 1.

Referring to FIGS. 1 and 7, the cigarette disposal assembly 10 of the invention is shown comprised of a cylindrical base member 11 having a flared bottom portion 16. A removable top member 12 is shown mounted to the top of the base member 11. An inlet structure 13 having a flared inlet 14 is shown extending upward from the top member 12. The flared inlet 14 is preferably constructed of metal to receive combustible articles such as cigarette or cigar butts, matches, etc. A logo 20, an encircled lit cigarette, preferably in color, is shown disposed on the side of the cylindrical base member 11 to alert smokers that the disposal or receptacle assembly 10 is constructed for receiving smoking materials and combustible articles. The logo or signage 20, showing a lit cigarette, may be applied to or molded into the body of the base member 11. The base member is preferably constructed of roto-molded granite speckled color design or the like.

Figure 2:
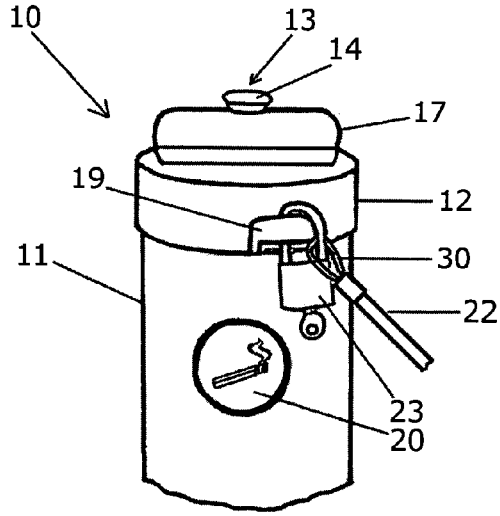
FIG. 2 is a top perspective view of the assembly of FIG. 1.
Figure 3:
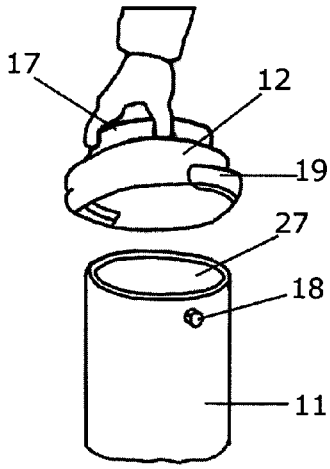
FIG. 3 is a perspective view of the assembly showing the top removed from the base structure.

Referring further to FIGS. 3 and 7, the removable top member 12 is shown to have a handle member 17 extending upwardly therefrom and which may be used to grip, lock and move the assembly 10. Peripheral locking members 19 are shown extending peripherally outward from the top member 12 and which cooperate with outwardly extending pegs 18 at the top of the base member 11, as particularly shown in FIG. 3. The opposing pegs or tabs 18 are adapted to receive the peripheral locking members 19 of top member 12. The top member 12 may be removed or attached to the base member 11 by a ¼ turn or revolution of the top member 12 with respect to the base member 11. As shown particularly in FIGS. 2 and 7, the handle member 19 has an aperture 32 through which the shackle of the padlock structure 23 is secured. The loop 30 of the securement cable 22 is also shown attached to the lock structure 23.

Figure 5:
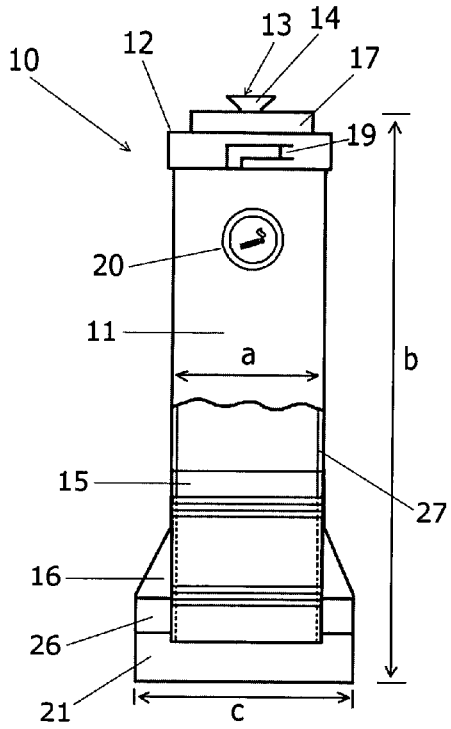
FIG. 5 is a lateral plan view, partially in section, of the assembly of FIG. 1.
Figure 6:
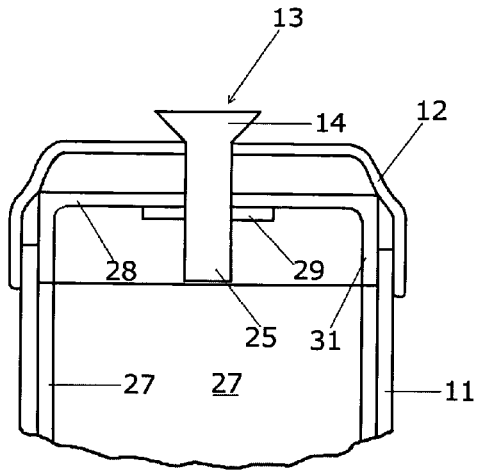
FIG. 6 is a sectional view of the upper portion of the disposal assembly.

Referring to FIGS. 5 and 6, the inlet structure 13 is shown comprised of a flared upper portion 14 and a downwardly extending conduit 25. The inlet structure 13 is preferably constructed of a non-combustible material, such as metal or the like. A combustible article such as a lit cigarette or match is extinguished on the flared upper portion 14. The extinguished cigarette butt falls through the conduit 25 and into a container 15 constructed of a non-combustible material, i.e., metal or the like, which is shown positioned adjacent the bottom of the base member 11. At the flared bottom 16 of the base member 11 a quantity of sand or like weighted material is preferably placed to provide stability for the assembly 10. Space 26 above the sand 21 allows the sand to flow and settle within the flared base bottom 16. The container 15 is preferably tightly fitted within the base member 11, for example, via a frictional fit or by fastening means. A non-combustible liner 27, i.e., metal, aluminum or the like, or other non-combustible structure is shown positioned within and adjacent the interior wall of the base member 11. Alternatively, the base member 11 may be constructed of a thermoset crosslinked polymer, i.e., crosslinked P.E., which would eliminate the requirement for the bucket member 15 or similar container or a metal liner within the base member. In the latter cases, however, means, such as a non-combustible plate, may be provided within the base to secure the sand or similar weighted material in the bottom of the base member 11.

Referring to FIG. 6, the inlet structure 13 is shown secured to the top member 12 by means of a seal structure 28 and a securement structure 29. The seal structure 28 is shown disposed in touching relationship with the inside of the top member 12. The seal structure 28 is preferably a circular member having a downwardly extending peripheral lip 31. As shown, when the top member 12 is secured to the top of the base structure 11, the side wall of the structure 11 is disposed between the top member 12 and the peripheral lip 31 of the seal structure 28. Further, the top of the liner 27 is shown in abutment with the peripheral lip 31. In this manner, the top member 12 may be secured in sealing engagement with the base structure 11 to thereby minimize the entry of air into the disposal assembly 10 and to minimize the exit of ashes and soot from the interior of base structure 11.

FIG. 6 further shows the inlet structure 13 secured to the top member 12 and the seal structure 28 by means of a securement structure 29. The securement structure 29 may be a slot cut out from the conduit 25 and which is bent into a horizontal position to secure inlet structure 13 and to provide a unitary structure comprising the top member 12, inlet structure 13 and seal structure 28.

Figure 8:
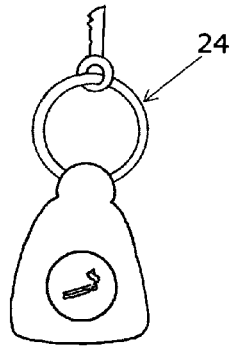
FIG. 8 is a plan view of the padlock key structure used to secure the assembly of the invention.
Figure 9:
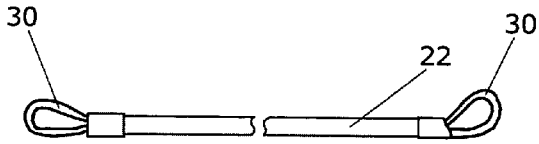
FIG. 9 is a plan view of the securement cable assembly used to secure the assembly of the invention.

Referring to FIGS. 2, 8 and 9, a securement cable 22, i.e., a 0.25 inch diameter steel cable approximately 5 feet long, padlock structure 23 and key structure 24 combination may be used to secure the top member 12 to the base member 11 as well as the assembly 10 to a secure object, i.e., a bench or building component. Apertures in the handle member(s) 19 may be provided for the utilization of the securement cable 22 and the padlock 23, respectively.

Figure 4:
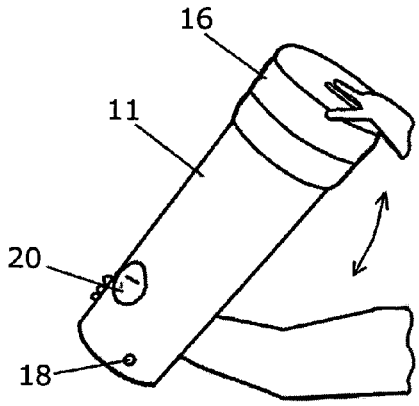
FIG. 4 is a perspective view showing the base structure being emptied.

In use, combustible articles such as cigarette butts, for example, are put out on the flared inlet 14 of the inlet structure 13 and dropped down through conduit 25 into the container 15. The lack of oxygen supply in the base structure 11, prevents combustion and the size or diameter of the conduit 25 limits the material that can enter base structure 11. As shown in FIGS. 3 and 4, to empty the disposal assembly 10, the top member 12 is removed from base structure 11 and turned upside down to discard the cigarette butt contents.

An exemplary disposal assembly 10, as shown in FIG. 5, has a flared inlet 14 and conduit structure 25 of approximately 2 inches in length to prevent clogging, a base structure 11 having a height "b" of approximately 25 inches, a diameter "b" of approximately 7 inches and a flared base bottom 16 having a diameter "c" of approximately 9 inches. The seal structure 28, as shown in FIG. 6, would have a diameter of approximately 6 inches in this assembly 10 configuration. The seal structure 28 is constructed of a ¼ inch thick molded non-combustible material, i.e., crosslinked thermoset polyethylene. The container 15 may be a #10 metal container (one gallon content) which is affixed to the interior of the base member 11. The amount of sand 21 in the base member 11 of the cigarette disposal assembly 10 having these dimensions is approximately five pounds.

As many changes are possible to the embodiments of this invention, utilizing the teachings thereof, the description above and the accompanying drawings should be interpreted in the illustrative and not the limited sense.

That which is claimed is:

1. A cigarette disposal assembly comprising:

a) a base member having a bottom portion, a generally tubular housing portion extending therefrom, and an open top, a liner positioned within said tubular housing portion, said liner having an upper edge;

b) a cover member adapted for securement to said open top of said base member, a seal structure having a circumferential lip spaced from said cover member, said cover member having a peripherally downwardly extending lip portion forming an annular void with said spaced lip portion of said seal structure to receive said open top of said base member and to abut said upper edge of said liner;

c) an inlet member having a flared top extending above said cover member, and a conduit portion extending through said cover member and said seal structure and terminating in said tubular housing of said base member; and d) means to secure said cover member to said open top of said base member.

2. The cigarette disposal assembly of claim 1, wherein said bottom portion of said base member is flared outwardly from said tubular housing.

3. The cigarette disposal assembly of claim 1, wherein said means to secure said cover member is comprised of at least one outwardly extending peripheral portion and a cooperating outwardly extending body member from said generally tubular housing.

4. The cigarette disposal assembly of claim 1, wherein said conduit portion of said inlet member is a metal conduit and wherein said base member and said cover member are constructed of a polymeric material.

5. The cigarette disposal assembly of claim 1, wherein a weight is positioned within said bottom portion of said base member and wherein said base member has securement means comprised of a cable attached to said tubular housing.

6. The cigarette disposal assembly of claim 1, wherein said base member is cylindrical in structure, wherein said cover member is generally circular and having a handle portion extending therefrom and wherein said flared top of said inlet member extends upwardly from said handle portion.

7. The disposal assembly for combustible items of claim 1, wherein said tubular housing of said base member has a logo to indicate smoking allowance.

8. The disposal assembly for combustible items of claim 1, wherein said base member has a container fixed at the bottom thereof and wherein said liner abuts said container.

9. The disposal assembly for combustible items of claim 8, wherein said container is cylindrical and wherein a weighted material is positioned about said container within said flared bottom portion.

10. The disposal assembly for combustible items of claim 9, wherein said weighted material is sand.

11. The cigarette disposal assembly of claim 2, wherein said upper edge of said liner terminates below said open top of said base member and wherein said seal structure is constructed and arranged to be in a unitary arrangement with said cover member and said inlet member.

12. A receptacle for receiving and disposing of combustible articles comprising:

a) a base enclosure structure having a cavity and an opening structure, said base enclosure structure having a generally tubular housing having a wall with a liner and a bottom container aligned therewith, said tubular housing of said base enclosure structure having a flared bottom and said container being fixed in said flared bottom and further having a quantity of a weighted material surrounding said container in said flared bottom;

b) a cover member adapted for securement to said opening structure of said base enclosure structure, said cover member having a seal structure for engagement with said opening structure of said base enclosure structure; and c) an inlet port extending from said cavity in said base enclosure structure and having a flared end terminating outside said receptacle, said inlet port being secured in said cover member and comprising a conduit portion extending through said cover member and said seal structure and into said cavity of said base enclosure structure.

13. The receptacle of claim 12, further comprising means to lock said cover member to said opening structure of said base enclosure structure.

14. A disposal assembly for combustible items comprising:

a) a generally cylindrical base structure with a liner for holding combustible items;

b) a top member being cooperating with and removable from said base structure, said top member having a flared inlet extending upward therefrom for receiving combustible items and a conduit extending from said flared inlet for guiding said combustible items into said base structure, said top member further having a seal structure extending downwardly therefrom for engaging said liner of said base structure, said top member and seal structure being constructed and arranged to secure said conduit in said top member, said top member further including a handle member, and said flared inlet extending upward from said handle member; and c) a locking means for securing said removable top member to said base structure.

15. The disposal assembly for combustible items of claim 14, wherein said base structure has a flared weighted bottom portion.

16. The disposal assembly for combustible items of claim 14, wherein said flared inlet and said conduit are made of metal and wherein said base structure is made of a molded polymeric composition.

17. The disposal assembly for combustible items of claim 14, wherein said top member has at least one peripheral locking member and wherein said base member has at least one outwardly extending peg.

18. The disposal assembly for combustible items of claim 17, wherein said locking means comprises said at least one peripheral locking member of said top member cooperating with said at least one outwardly extending peg of said base structure.

19. The disposal assembly for combustible items of claim 14, wherein said assembly further includes a securement device comprising a security cable and lock.

* * * * *